US006834178B2

(12) United States Patent
Takeda

(10) Patent No.: US 6,834,178 B2
(45) Date of Patent: Dec. 21, 2004

(54) SHEET CONVEYING DEVICE WITH SENSOR POSITIONED AT VERTICAL ANGLE AND IMAGE FORMING APPARATUS CONTAINING SAME

(75) Inventor: Shohei Takeda, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 15 days.

(21) Appl. No.: 10/305,958

(22) Filed: Nov. 29, 2002

(65) Prior Publication Data

US 2003/0108372 A1 Jun. 12, 2003

(30) Foreign Application Priority Data

Dec. 12, 2001 (JP) ..... 2001-378122

(51) Int. Cl.[7] ..... G03G 15/00

(52) U.S. Cl. ..... 399/388; 399/394; 399/395

(58) Field of Search ..... 399/388, 389, 399/394, 395

(56) References Cited

U.S. PATENT DOCUMENTS 5,751,443 A * 5/1998 Borton et al. ..... 399/389

* cited by examiner

*Primary Examiner*—William J. Royer
(74) *Attorney, Agent, or Firm*—Fitzpatrick, Cella, Harper & Scinto

(57) ABSTRACT

A sheet conveying device has a sheet-position detection sensor which has CCDs or CISs and which is attached in an inclined manner such that a vertical distance from the sheet-position detection sensor to a sheet-conveying path or to a sheet conveyed along the sheet-conveying path differs between the proximal edge and the distal edge of the sheet-position detection sensor in a direction perpendicular to the sheet-conveying path.

11 Claims, 7 Drawing Sheets

SHEET CONVEYING DEVICE WITH SENSOR POSITIONED AT VERTICAL ANGLE AND IMAGE FORMING APPARATUS CONTAINING SAME

BACKGROUND OF THE INVENTION

1. Field of the Invention

The present invention relates to sheet conveying devices for conveying sheets and image forming apparatuses including the sheet conveying devices, such as copy machines, printers, facsimile machines, and compound machines having these functions.

2. Description of the Related Art

Generally, some image forming apparatuses have a construction for image position adjustment shown in FIGS. 6 and 7 in order to adjust the positional relationship between a sheet on which an image is to be formed and the image formed on a photosensitive drum, and the like in an image forming unit.

FIG. 6 is a side view of a sheet-conveying path U along which the sheet is conveyed to the image forming unit of the image forming apparatus. In FIG. 6, reference numeral 104 denotes a photosensitive drum for forming an image, reference numeral 302 denotes a laser for forming a latent image on the photosensitive drum 104, reference numeral 108 denotes resist rollers which determine the time for feeding the sheet such that the positional relationship between the latent image formed on the photosensitive drum 104 and the sheet on which the image is to be formed is adjusted, and reference numeral 304 denotes a sheet-position detection sensor for detecting the front end of the sheet in the sheet-feeding direction.

FIG. 7 is a top view of the sheet-conveying path U. In FIG. 7, P denotes the sheet and reference numeral 2 denotes the sheet-feeding direction.

In operation of the apparatus shown in FIGS. 6 and 7, when the sheet P is conveyed along the sheet-conveying path U, a central processing unit CPU (not shown), which serves as a control unit, determines the position of the sheet P in the sheet-feeding direction 2 by using the sheet-position detection sensor 304 and adjusts the time for transmitting image data to the laser 302 from an image control block (not shown).

However, the above-described operation of the conventional apparatus has the following problem. That is, when the image forming speed of the image forming apparatus increases, the sheet conveying speed also increases, and the sheet-position detection sensor 304 positioned along the sheet-feeding direction 2 must be capable of accurately reading sheets at high speed. However, typical mechanical sheet-position detection sensors used in such devices cause a large error, which directly leads to displacement of the image on the sheet.

In order to solve this problem, an image forming apparatus has been proposed which ensures high resolution and high image position accuracy even when the image forming speed is high by using as the sheet-position detection sensor 304 a sheet-position detection sensor including charge coupled devices (CCDs) or contact image sensors (CISs) in which the reading area can be varied.

However, in the image forming apparatus in which a sheet-position detection sensor including the CCDs or the CISs is used, a detectable area in which a target can be detected (hereinafter referred to as the depth of field) is small, and therefore the distance between the sheet-position detection sensor and the sheet being conveyed must be adjusted precisely. Accordingly, high-precision components are required in order to attach the sheet-position detection sensor with high precision, and fine adjustment must be performed after attaching the sheet-position detection sensor. Therefore, high costs are incurred.

SUMMARY OF THE INVENTION

According to the present invention, a sheet conveying device includes a pair of sheet guides forming a sheet-conveying path for conveying a sheet and an image sensor for detecting the sheet as it is conveyed along the sheet-conveying path, wherein the image sensor is retained in a direction perpendicular to the sheet-conveying path, and wherein the image sensor is attached such that a vertical distance from a proximal edge of the image sensor to one of the pair of sheet guides differs from the vertical distance from the distal edge of the image sensor to one of the pair of sheet guides in the direction perpendicular to the sheet-conveying path.

As described above, according to the present invention, the sheet-position detection sensor (image sensor) is attached such that the vertical distance from a proximal edge of the sheet-position detection sensor to one of the pair of sheet guides differs from the vertical distance from the distal edge of the sheet-position detection sensor to one of the pair of sheet guides in a direction perpendicular to the sheet-conveying path. Accordingly, it is not necessary to prepare high-precision components for attaching the sheet-position detection sensor or to reduce a gap between conveyor guide members for guiding the sheet and adjust the sheet-position detection sensor as in the sheet-position detection sensor of the known art. In addition, the depth of field of the sheet-position detection sensor, in which the sheet being conveyed can be detected, is effectively increased, so that it is not necessary to adjust the distance between the sheet-position detection sensor and the sheet being conveyed with high precision. Accordingly, the costs can be greatly reduced and sheet-conveying performance can be greatly improved.

Further objects, features and advantages of the present invention will become apparent from the following description of the preferred embodiments with reference to the attached drawings.

DESCRIPTION OF THE PREFERRED EMBODIMENTS

An image forming apparatus according to an embodiment of the present invention will be described below with reference to FIGS. 1 to 5. First, the overall construction of the image forming apparatus will be described with reference to a schematic sectional view thereof shown in FIG. 1.

Figure 1:
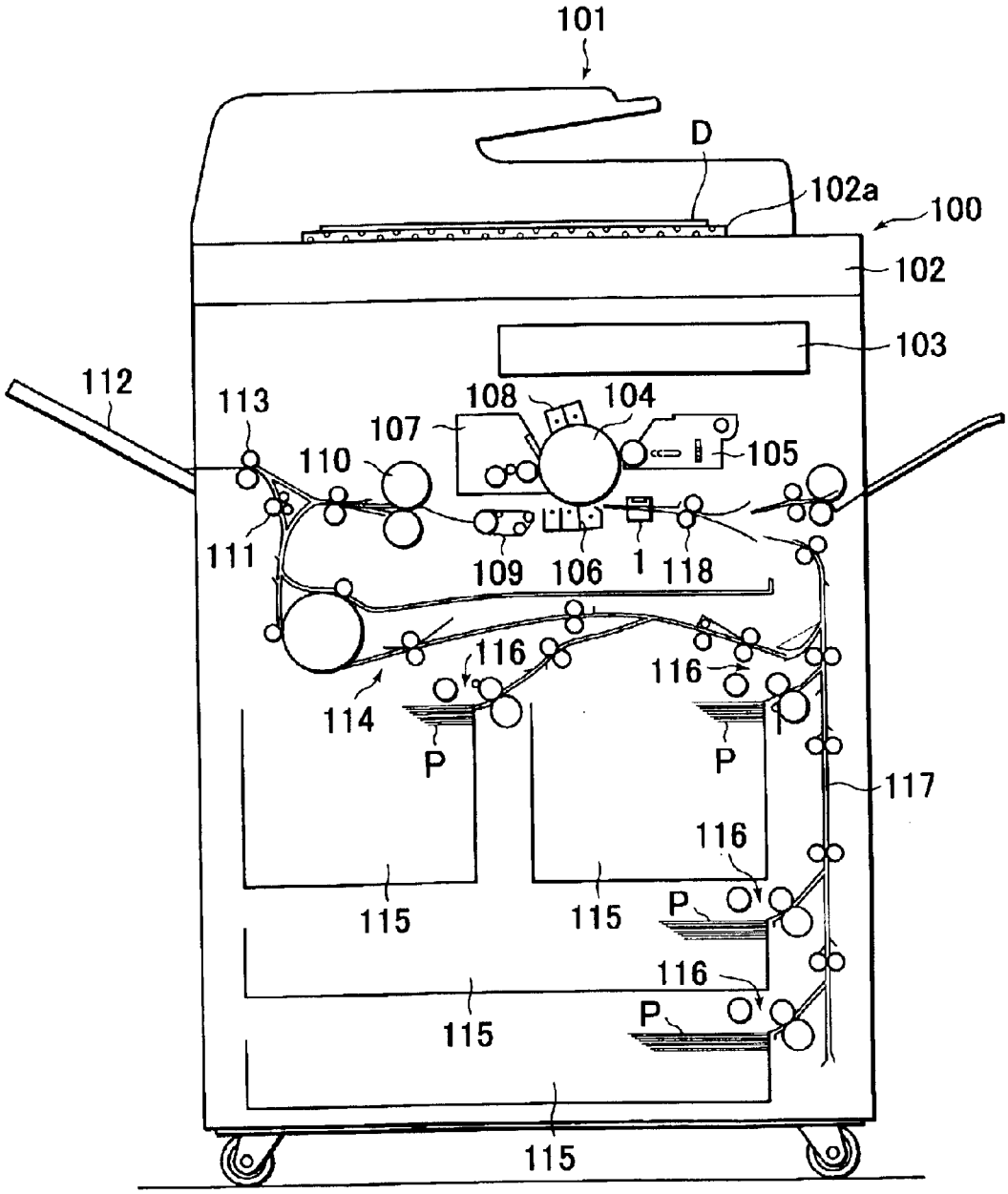
FIG. 1 is a sectional view of an image forming apparatus according to an embodiment of the present invention.

In FIG. 1, reference numeral 100 denotes the main body of a copy machine, and an automatic document feeder 101 for automatically feeding original copies is placed on the main body 100. In addition, a glass plate 102*a* for receiving an original document D is provided on the top surface of the main body 100, and a reader unit 102 disposed at the upper side of the main body 100 reads image information of the original document D which is fed to the glass plate 102*a* by the automatic document feeder 101.

Reference numeral 103 denotes an optical unit which radiates light having the image information of the original document D read by the reader unit 102, or other image information transmitted via a network, onto a predetermined position of the surface of a photosensitive drum 104, which serves as an image carrier.

The optical unit 103 includes a laser source which emits a laser beam which is turned on and off in accordance with an electrical signal processed and controlled by an image processing device (not shown) in correspondence with the image information read by the reader unit 102 or other image information transmitted via a network. In addition, the optical unit 103 also includes a plurality of optical components (not shown), for example, mirrors for reflecting the laser beam, optical elements (lenses) for optically magnifying and correcting the laser beam, which are arranged on a laser beam path from the laser source to the photosensitive drum 104.

Next, an image forming unit which forms an image on a sheet P will be described below. A developing device 105 which supplies the photosensitive drum 104 with toner in order to make an electrostatic latent image formed on the photosensitive drum 104 viewable, a transferring/separation device 106 which transfers the toner image onto the sheet P and separates the sheet P, which is retained on the photosensitive drum 104 by an electrostatic force, from the photosensitive drum 104, a cleaning device 107 which removes the toner remaining on the photosensitive drum 104, and a pre-exposure device 108 which clears the latent image remaining on the photosensitive drum 104 are disposed around the photosensitive drum 104.

Resist rollers 118 which correct skewing of the sheet P and determine the time for feeding the sheet P such that the positional relationship between the latent image formed on the photosensitive drum 104 and the sheet P is adjusted are placed upstream of the photosensitive drum 104 in the sheet-feeding direction. The operations of accurately determining the time for feeding the sheet P and correcting the displacement along the width of the sheet P are performed in accordance with a detection result obtained by a sheet-position detection sensor 1, which will be described below.

The sheet P onto which the toner image is transferred is conveyed by a conveying device 109 from the photosensitive drum 104 to a fixing device 110, which fixes the toner image by heating and pressing the sheet P. Then, after the sheet P is outputted from the fixing device 110, an output/reverse device 111 switches between an operation of outputting the sheet P to an output tray 112 disposed outside the main body by using output rollers 113 and an operation of conveying the sheet P to a refeeding device 114, which refeeds the sheet P to the photosensitive drum 104 for double-sided copying or overlapped copying.

Paper cassettes 115 are disposed at the lower side of the main body 100 of the copy machine, and stacks of sheets P to be fed to the image forming unit are stored in the paper cassettes 115 in correspondence with the size thereof. The sheets P placed on the sheet feeding cassettes 115 are picked up one-by-one by sheet feeding devices 116 and are conveyed toward the image forming unit via a vertical-path conveyor 117.

Next, the operation of the image forming apparatus having the above-described construction will be described in sequence below.

First, when a user pushes a copy-start button (not shown), the sheets P placed in one of the sheet feeding cassettes 115 are picked up one-by-one and conveyed to the vertical-path conveyor 117 by the sheet feeding device 116, and each sheet P is stopped when it reaches the resist rollers 118. Then, the reader unit 102 scans over the original document D and converts the image information of the original document D into an electrical signal, and the optical unit 103 radiates light having the image information of the original document D onto the surface of the photosensitive drum 104 via the image processing device (not shown). Accordingly, an electrostatic latent image corresponding to the image information is recorded on the photosensitive drum 104. This operation may also be performed by using image information obtained from an external device via a network.

In synchronization with the above-described operation, the resist rollers 118 start to convey the sheet P. At this time, the electrostatic latent image recorded on the photosensitive drum 104, which corresponds to the image information of the original document D, is formed into a toner image by the developing device 105, and the toner image is then transferred onto the sheet P by the transferring/separation device 106. After transfer of the toner image onto sheet P, sheet P is conveyed by the conveying device 109, and the toner image is fixed on sheet P by the fixing device 110. Then, if single-sided copying is being performed, the output/reverse device 111 conveys the sheet P to the output rollers 113, which output the sheet P from the main body 100 onto the output tray 112.

Whenever double-sided copying or overlapped copying is to be performed, the sheet P on which the toner image is fixed by the fixing device 110 is conveyed to the photosensitive drum 104 by the output/reverse device 111 and the refeeding device 114. Then, another toner image is transferred onto the sheet P, and the sheet P is transferred via the conveying device 109, the fixing device 110, the output/reverse device 111, and the output rollers 113, and the sheet P is output onto the output tray 112.

Next, the operation of the sheet-position detection sensor 1 in the image forming apparatus, which is the main part of the present invention, will be described below with reference to FIGS. 2 to 5.

Figure 2:
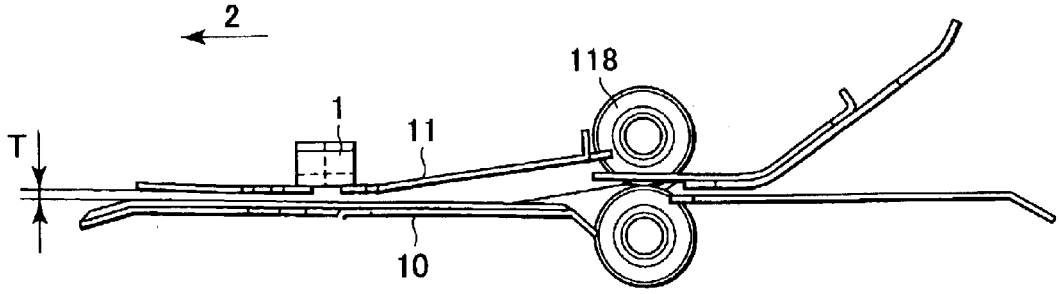
FIG. 2 is a sectional view of a part of the image forming apparatus shown in FIG. 1.

FIG. 2 is a sectional view of the resist rollers 118 and peripheral components thereof. In FIG. 2, reference numeral 1 denotes the sheet-position detection sensor using image sensors such as CCDs or CISs, reference numerals 10 and 11 denote conveyor guide members which guide the sheet conveyed by the resist rollers 118 toward the photosensitive drum 104, and T denotes the size of a gap between the conveyor guide members 10 and 11 (a gap through which the sheet can be conveyed). The sheet is conveyed by using the central position in the widthwise direction of the sheet-conveying path as a reference.

The vertical distance from the sheet-position detection sensor 1 to the sheet-conveying path or to the sheet conveyed along the sheet-conveying path at the edge of the sensor that is closer to the central position of the sheet in the widthwise direction thereof (hereinafter referred to as a distal edge) is set larger than the distance from the sheet-position detection sensor 1 to the sheet-conveying path or to the sheet conveyed along the sheet-conveying path at the other edge (hereinafter referred to as a proximal edge). Accordingly, the sheet-position detection sensor 1 is disposed in an inclined manner.

Figure 3A:
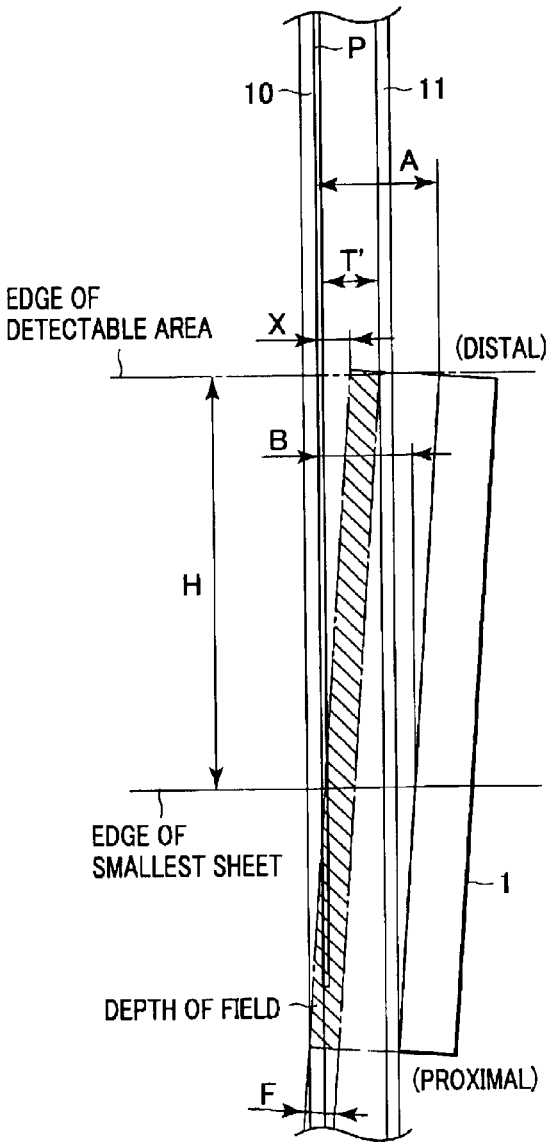
FIG. 3A is a diagram showing a sheet-position detection sensor and a sheet viewed from a sheet-feeding direction.
Figure 3B:
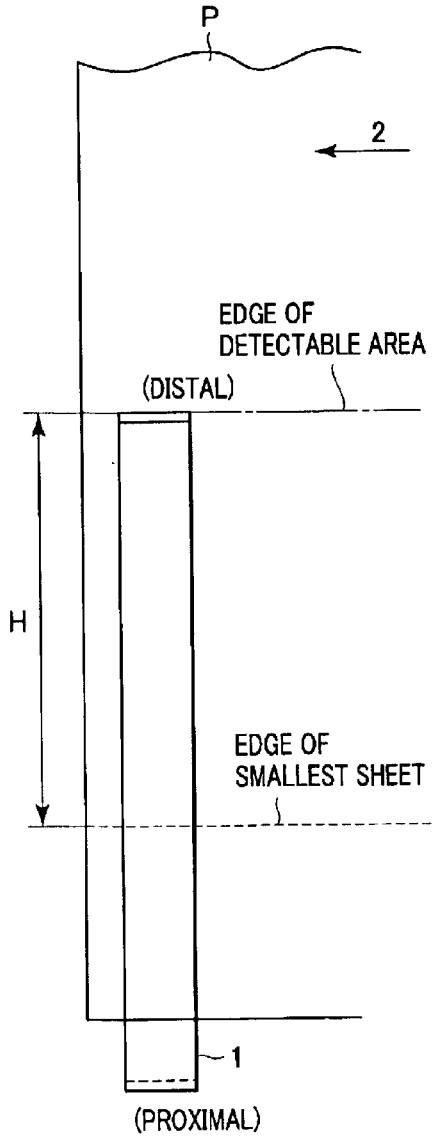
FIG. 3B is a diagram showing the sheet-position detection sensor and the sheet viewed from the top.

FIGS. 3A and 3B show the positional relationship between the sheet-position position detection sensor 1 and the sheet P and the conveyor guide members 10,11. FIG. 3A shows the sheet-position detection sensor 1 and the sheet P and the conveyor guide members 10,11 viewed from the sheet-feeding direction 2, and FIG. 3B shows the sheet-position detection sensor 1 and the sheet P and the conveyor guide members 10,11 viewed from the above.

With reference to FIGS. 3A and 3B, A is the distance between the sheet-position detection sensor 1 and the conveyor guide member 10 at the distal edge of the sheet-position detection sensor 1, B is the distance between the sheet-position detection sensor 1 and the conveyor guide member 10 at a position away from the distal edge of the sheet-position detection sensor 1 by a predetermined distance H (in the present embodiment, H is the distance to the edge of a sheet of the smallest conveyable size), and F is an actual depth of field of the sheet-position detection sensor 1 (0.4 mm in the present embodiment). The sheet-position detection sensor 1 is disposed such that the sheet P is at the position farthest from the sheet-position detection sensor 1 in the detectable area of the sheet-position detection sensor 1 at the predetermined distance H from the distal edge of the sheet-position detection sensor 1. In this case, by disposing the sheet-position detection sensor 1 in an inclined manner, $X=|A-B|$ is satisfied, as shown in FIG. 3A, and a gap T' through which the sheet can be conveyed is expressed as follows:

$$T'=X+F.$$

Accordingly, $T \leqq T'$ is satisfied in the above-described construction, and the detectable area of the sheet-position detection sensor 1 is effectively increased, so that the gap between the conveyor guide members 10 and 11 can be increased.

Therefore, even though the depth of field of the sheet-position detection sensor 1 is small, it is not necessary to attach it with high precision. Accordingly, the costs can be reduced. In addition, since the gap T between the conveyor guide members 10,11 can be optimized by adjusting the angle at which the sensor 1 is attached, jamming can be prevented and stable conveying performance can be obtained. In addition, as shown in FIG. 3A, the sheet-position detection sensor 1 is disposed such that the sheet P is inside the detectable area of the sheet-position detection sensor 1 at a position away from the distal edge of the sheet-position detection sensor 1 by the distance H between the distal edge of the sheet-position detection sensor 1 and the edge of the sheet of the smallest conveyable size. Accordingly, even when the sheet of the smallest conveyable size is conveyed, the sheet P can be detected by the sheet-position detection sensor 1.

Next, a method for using the sheet-position detection sensor 1 according to the present invention will be described below with reference to FIGS. 4 and 5.

Figure 4:
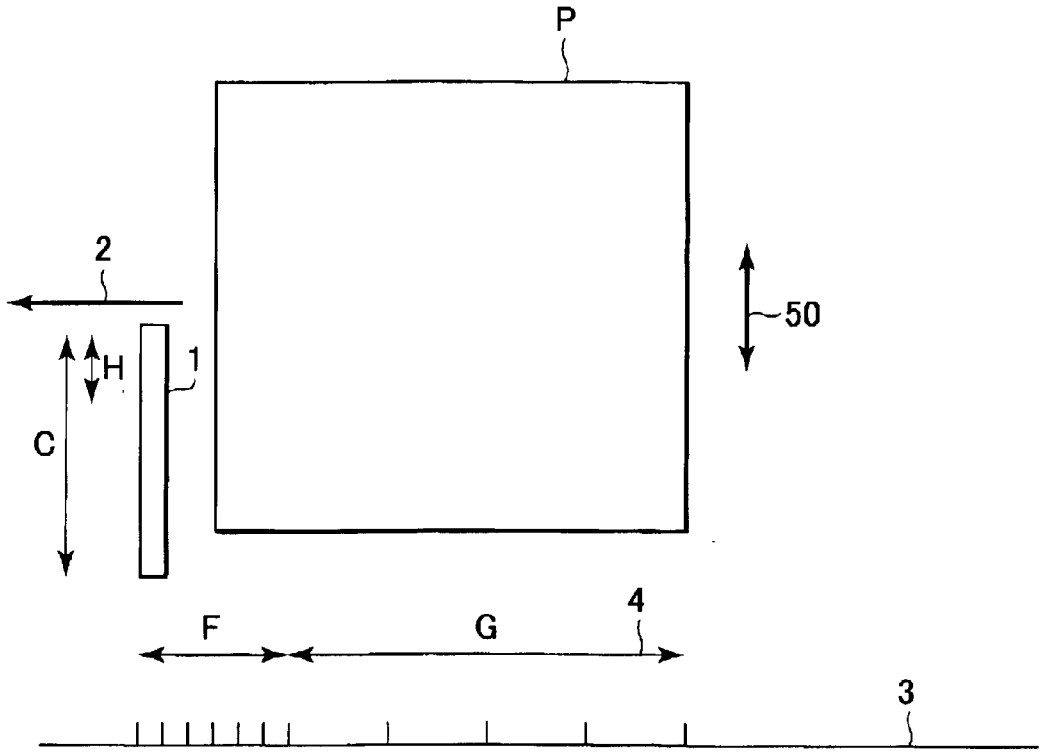
FIG. 4 is a diagram showing the operation of the image forming apparatus according to the present invention.

FIG. 4 is an explanatory diagram showing the manner in which the sheet-position detection sensor 1 according to the present invention is used. In FIG. 4, P denotes the sheet and reference numeral 1 denotes the sheet-position detection sensor according to the present invention which includes a photoelectric element array of CGDs or CISs. In addition, reference numeral 2 denotes the sheet-feeding direction, reference numeral 3 denotes a reference reading signal of the sheet-position detection sensor 1, and reference numeral 4 shows an operational mode of the sheet-position detection sensor 1 when the sheet P passes under the sheet-position detection sensor 1.

Figure 5:
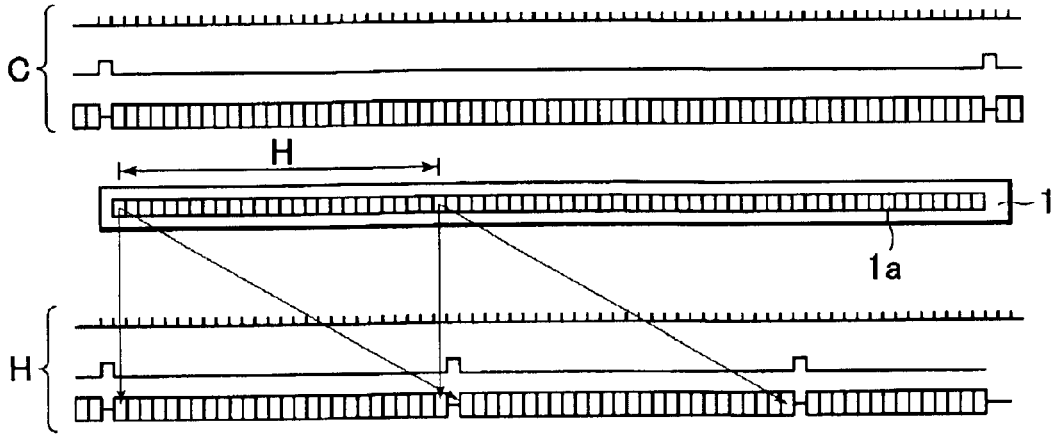
FIG. 5 is another diagram showing the operation of the image forming apparatus according to the present invention.
Figure 6:
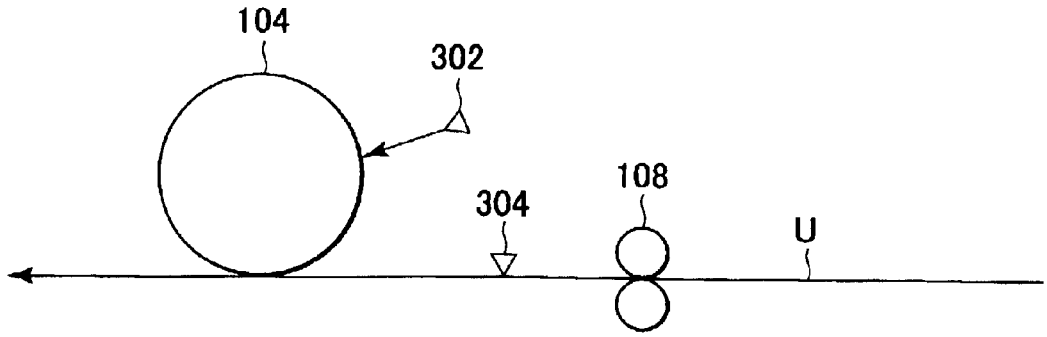
FIG. 6 PRIOR ART
FIG. 6 is a diagram showing the operation of an image forming apparatus of the known art.
Figure 7:
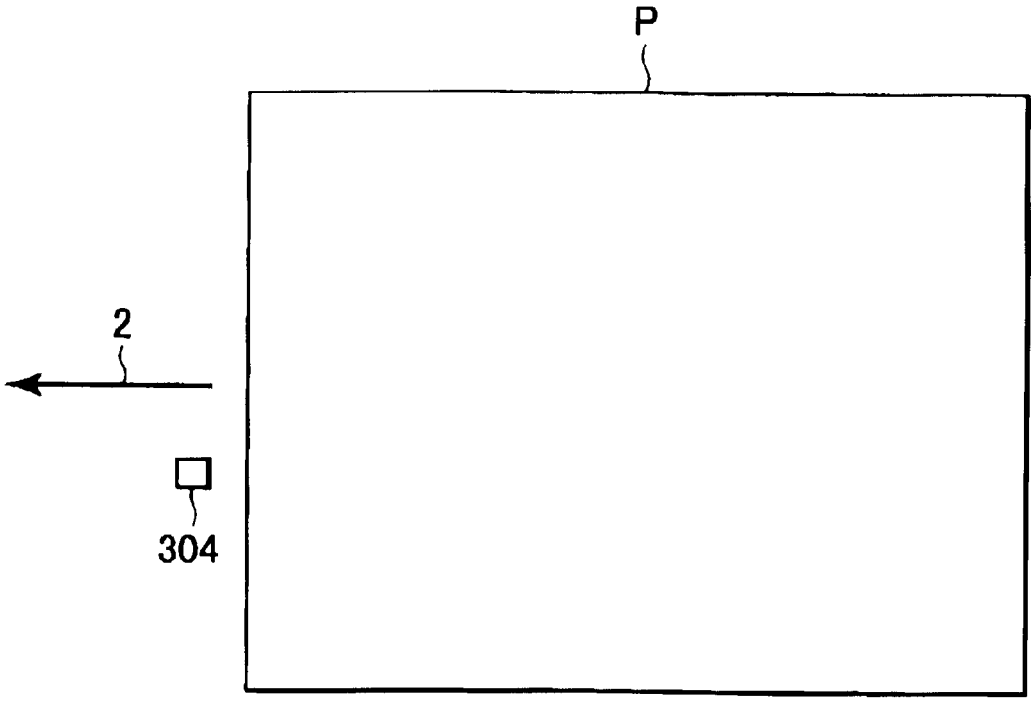
FIG. 7 PRIOR ART
FIG. 7 is another diagram showing the operation of an image forming apparatus of the known art.

FIG. 5 is a diagram showing the operation of the sheet-position detection sensor 1 according to the present invention. With reference to FIG. 5, n photoelectric transducers 1*a* are arranged in the sheet-position detection sensor 1. The timing chart C shown at the upper side in FIG. 5 corresponds to the area C in FIG. 4. In addition, the timing chart H shown at the lower side in FIG. 5 corresponds to the area H in FIG. 4.

First, when an image-forming operation is performed, the sheet P is conveyed from the resist rollers 118 shown in FIG. 2 toward the photosensitive drum 104. At this time, in order to adjust the position of the image, the time at which the sheet P is fed in the sheet-feeding direction 2 and the displacement of the sheet P in the direction 2 perpendicular to the sheet-feeding direction (shown by the arrow 50) are detected, and the obtained detection data is transmitted to a control unit (not shown), which corrects data transmitted to the laser.

In the present embodiment, while the front end of the sheet P is approaching the sheet-position detection sensor 1, the detection is performed at short intervals by reducing the number of effective pixels in the sheet-position detection sensor 1 in order to detect the time at which the sheet P is fed in the direction shown by the arrow 2. This operation corresponds to the region F in FIG. 4. Then, after the front end of the sheet P is detected, a side edge of the sheet P is detected with a maximum number of effective pixels of the sheet-position detection sensor 1 in order to obtain the displacement of the sheet P in the direction shown by the arrow 50 (width direction of the sheet, which is perpendicular to the sheet-feeding direction). This operation corresponds to the region G shown in FIG. 4.

At this time, since it is sufficient if the operation of detecting the side edge of the sheet P is performed while the sheet P is passing under the sheet-position detection sensor 1, it is possible to adjust (increase) the detection accuracy of the sheet-position detection sensor 1. Accordingly, the detection accuracy can be prevented from being reduced even when the sheet-position detection sensor 1 is attached in an inclined manner.

According to the above-described construction, both the time at which the sheet P is fed in the sheet-feeding direction 2 and the displacement of the sheet P in the direction shown by the arrow 50, which is perpendicular to the sheet-feeding direction 2 can be detected by using a single sheet-position detection sensor 1. The position at which the image is formed on the photosensitive drum 104 is accurately adjusted on the basis of the detection result. Accordingly, the image can be transferred onto the sheet P with high accuracy.

Although an embodiment of the present invention has been described, the present invention is not limited to the above-described embodiment. For example, in the above-described embodiment, the sheet-position detection sensor 1 for detecting the time at which the sheet P is fed and the displacement of the sheet P is placed downstream of the resist rollers in the sheet-feeding direction 2. However, the present invention is not limited to this, and the sheet-position detection sensor 1 according to the present invention may be disposed at any position along the sheet-conveying path as long as it includes a photoelectric element array of CCDs or CISs and detects the sheet being conveyed.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. A sheet conveying device comprising:

a pair of sheet guides forming a sheet-conveying path for conveying a sheet; and an image sensor for detecting the sheet as the sheet is conveyed along the sheet-conveying path;

wherein the image sensor extends in a direction perpendicular to the sheet-conveying path, wherein the image sensor is attached such that a vertical distance from one edge of the image sensor to one of the pair of sheet guides differs from a vertical distance from an other edge of the image sensor to one of the pair of sheet guides, and wherein when T is the size of a gap of the sheet-conveying path through which the sheet can be conveyed, A is a distance from the one edge of the image sensor to one of the pair of sheet guides, B is a distance from a position of the image sensor away from the one edge toward the other edge of the image sensor by a predetermined distance H to one of the pair of sheet guides, and F is a predetermined depth of field of the image sensor, the image sensor is inclined relative to one of the pair of sheet guides so that the following condition is satisfied:

$$T \leqq |A-B|+F.$$

2. A sheet conveying device according to claim 1, wherein the image sensor comprises one of a CCD and a CIS.

3. A sheet conveying device according to claim 1, wherein the sheet-conveying path is adapted to convey sheets of different sizes, and the image sensor is disposed such that the sheet conveyed along the sheet-conveying path is inside the detectable area of the image sensor at a position away from the one edge toward the other edge of the image sensor by a distance corresponding to a distance between the one edge of the image sensor and an edge of a sheet having the smallest size.

4. A sheet conveying device according to claim 1, wherein the sheet-conveying path is adapted to convey sheets of different sizes, and wherein the predetermined distance H is a size of a sheet having the smallest size.

5. An image forming apparatus comprising:

an image forming unit for forming an image on a sheet;

a pair of sheet guides forming a sheet-conveying path for conveying the sheet to the image forming unit; and an image sensor for detecting the sheet as the sheet is conveyed along the sheet-conveying path, wherein the image sensor extends in a direction perpendicular to the sheet-conveying path, wherein the image sensor is attached such that a vertical distance from one edge of the image sensor to one of the pair of sheet guides differs from a vertical distance from an other edge of the image sensor to one of the pair of sheet guides, and wherein when T is the size of a gap of the sheet-conveying path through which the sheet can be conveyed, A is a distance from the one edge of the image sensor to one of the pair of sheet guides, B is a distance from a position of the image sensor away from the one edge toward the other edge of the image sensor by a predetermined distance H to one of the pair of sheet guides, and F is a predetermined depth of field of the image sensor, the image sensor is inclined relative to one of the pair of sheet guides so that the following condition is satisfied:

$$T \leqq |A-B|+F.$$

6. An image forming apparatus according to claim 5, wherein the image sensor detects the displacement of a side edge of the sheet along a sheet-feeding direction in order to correct the position at which the image is formed in the image forming unit with respect to the position of the sheet on which the image is to be recorded.

7. An image forming apparatus according to claim 6, wherein the image sensor detects the front end of the sheet in order to determine the time at which the image is to be formed in the image forming unit.

8. An image forming apparatus according to claim 5, wherein the image sensor comprises one of a CCD and a CIS.

9. A sheet conveying device according to claim 5, wherein the sheet-conveying path is adapted to convey sheets of different sizes, and wherein the predetermined distance H is a size of a sheet having the smallest size.

10. A sheet conveying device comprising:

a pair of sheet guides forming a sheet-conveying path for conveying a sheet; and an image sensor for detecting the sheet as the sheet is conveyed along the sheet-conveying path;

wherein the image sensor extends in a direction perpendicular to the sheet-conveying path, wherein the image sensor is attached such that a vertical distance from one edge of the image sensor to one of the pair of sheet guides differs from a vertical distance from an other edge of the image sensor to one of the pair of sheet guides, wherein the image sensor detects a side edge of the sheet along a sheet-feeding direction.

11. An image forming apparatus comprising:

an image forming unit forming an image on a sheet;

a pair of sheet guides forming a sheet-conveying path for conveying the sheet to the image forming unit; and an image sensor for detecting the sheet as the sheet is conveyed along the sheet-conveying path, wherein the image sensor extends in a direction perpendicular to the sheet-conveying path, wherein the image sensor is attached such that a vertical distance from one edge of the image sensor to one of the pair of sheet guides differs from a vertical distance from an other edge of the image sensor to one of the pair of sheet guides, wherein the image sensor detects a side edge of the sheet along a sheet-feeding direction in order to correct the position at which the image is formed in the image forming unit with respect to the position of the sheet on which the image is to be recorded.

* * * * *

UNITED STATES PATENT AND TRADEMARK OFFICE

CERTIFICATE OF CORRECTION

PATENT NO. : 6,834,178 B2
DATED : December 21, 2004
INVENTOR(S) : Shohei Takeda

It is certified that error appears in the above-identified patent and that said Letters Patent is hereby corrected as shown below:

Column 4,
Lines 4 and 12, “one-by-one” should read -- one by one --.

Column 5,
Line 9, “sheet-position position” should read -- sheet-position --.

Column 6,
Line 16, “4,” should read -- 4. --. ¶ Next, the operation will be described below with reference to FIGS. 2 and 4. --.
Line 22, “direction 2” should read -- direction --.
Line 53, “direction 2” should read -- direction 2, --.

Signed and Sealed this

Twenty-sixth Day of April, 2005

JON W. DUDAS
*Director of the United States Patent and Trademark Office*